United States Patent [19]

Sowinski et al.

[11] Patent Number: 4,656,122

[45] Date of Patent: Apr. 7, 1987

[54] REVERSAL PHOTOGRAPHIC ELEMENTS CONTAINING TABULAR GRAIN EMULSIONS

[75] Inventors: Allan F. Sowinski, Rochester; David C. Shuman, Victor, both of N.Y.

[73] Assignee: Eastman Kodak Company, Rochester, N.Y.

[21] Appl. No.: 822,516

[22] Filed: Jan. 27, 1986

Related U.S. Application Data

[63] Continuation-in-part of Ser. No. 698,053, Feb. 4, 1985, abandoned.

[51] Int. Cl.[4] ..... G03C 1/02; G03C 7/00

[52] U.S. Cl. ..... 430/505; 430/503; 430/571; 430/567; 430/568

[58] Field of Search ..... 430/567, 568, 571, 505, 430/503

[56] References Cited

U.S. PATENT DOCUMENTS

| | | | |
|---|---|---|---|
| 2,411,096 | 11/1946 | Knott | 430/568 |
| 3,152,907 | 10/1964 | Godowsky | 430/554 |
| 3,600,180 | 8/1971 | Judd et al. | 430/567 |
| 4,082,553 | 4/1978 | Groet | 430/505 |
| 4,229,525 | 10/1980 | Ueda | 430/569 |
| 4,369,248 | 1/1983 | Ranz et al. | 430/551 |
| 4,400,463 | 8/1983 | Maskasky | 430/567 |
| 4,433,048 | 2/1984 | Solberg et al. | 430/567 |
| 4,434,226 | 2/1984 | Wilgus et al. | 430/567 |
| 4,435,501 | 3/1984 | Maskasky | 430/567 |
| 4,439,520 | 3/1984 | Kofron et al. | 430/567 |

FOREIGN PATENT DOCUMENTS 3402840 3/1984 Fed. Rep. of Germany .

OTHER PUBLICATIONS

*Research Disclosure,* Item 22534, vol. 225, Jan., 1983.

*Primary Examiner*—Won H. Louie
*Attorney, Agent, or Firm*—Carl O. Thomas

[57] ABSTRACT

Silver halide photographic elements are disclosed capable of producing reversal images including at least one emulsion layer comprised of a blend of tabular silver haloiodide grains and relatively fine grains consisting essentially of a silver salt more soluble than silver iodide.

21 Claims, 10 Drawing Figures

REVERSAL PHOTOGRAPHIC ELEMENTS CONTAINING TABULAR GRAIN EMULSIONS

This is a continuation-in-part of U.S. Ser. No. 698,053, filed Feb. 4, 1985, now abandoned.

FIELD OF THE INVENTION

This invention relates to improved photographic elements adapted for producing reversal images. More specifically, this invention relates to reversal silver halide photographic elements containing in at least one emulsion layer tabular haloiodide grains.

BACKGROUND OF THE INVENTION

The term "silver haloiodide" is employed in its art recognized usage to designate silver halide grains containing silver ions in combination with iodide ions and at least one of chloride and bromide ions. The term "reversal photographic element" designates a photographic element which produces a photographic image for viewing by being imagewise exposed and developed to produce a negative of the image to be viewed, followed by uniform exposure and/or fogging of residual silver halide and processing to produce a second, viewable image. Color slides, such as those produced from Kodachrome® and Ektachrome® films, constitute a popular example of reversal photographic elements. In the overwhelming majority of applications the first image is negative and the second image is positive. Groet U.S. Pat. No. 4,082,553 illustrates a conventional reversal photographic element containing silver haloiodide grains modified by the incorporation of a small proportion of fogged silver halide grains. Hayashi et al German OLS No. 3,402,840 is similar to Groet, but describes the imaging silver halide grains in terms of those larger than and smaller than 0.3 micrometer and additionally requires in addition to the fogged silver halide grains or their metal or metal sulfide equivalent an organic compound capable of forming a silver salt of low solubility.

High aspect ratio tabular grain silver haloiodide emulsions have been recognized to provide a variety of photographic advantages, such as improvements in speed-granularity relationships, increased image sharpness, and reduced blue speed of minus blue recording emulsion layers. High aspect ratio tabular grain silver haloiodide emulsions in reversal photographic elements are illustrated by *Research Disclosure* Vol. 225, Jan. 1983, Item 22534; Wilgus et al U.S. Pat. No. 4,434,226; Kofron et al U.S. Pat. No. 4,439,520; Solberg et al U.S. Pat. No. 4,433,048; Maskasky U.S. Pat. No. 4,400,463; and Maskasky U.S. Pat. No. 4,435,501. *Research Disclosure* is published by Kenneth Mason Publications, Ltd., The Old Harbourmaster's, 8 North Street, Emsworth, Hampshire P010 7DD, England.

SUMMARY OF THE INVENTION

In one aspect this invention is directed to a photographic element capable of forming a reversal image comprising a support and, coated on the support, at least one image recording emulsion layer comprised of a dispersing medium and a blend of radiation sensitive tabular silver haloiodide grains having a thickness of less than 0.5 μm and an average aspect ratio of greater than 8:1 accounting for at least 35 percent of the total grain projected area of said emulsion layer and a second grain population present in a concentration sufficient to improve reversal photographic imaging, said second grain population being incapable of forming a latent image extending the exposure latitude imparted to said emulsion layer by said tabular grains, having an average diameter less than that of said tabular grains and less than 0.5 μm consisting essentially of a silver salt more soluble than silver iodide, and containing less iodide than said tabular grains.

It has been discovered that the addition of relatively fine grains consisting essentially of a silver salt more soluble than silver iodide to an emulsion layer containing tabular silver haloiodide grains can produce a combination of advantages in reversal imaging. The reversal threshold speed of the reversal photographic elements can be increased. At the same time, reduced toe region density in the reversal image as well as increases in maximum density and contrast are observed.

To permit the advantages of the present invention to be visualized more easily, the relative reversal imaging performance of a photographic element according to the present invention and a conventional reversal photographic element differing solely by the absence of the relatively fine grains consisting essentially of a silver salt more soluble than silver iodide is illustrated schematically in FIG. 1. Curve 1 is the reversal characteristic curve produced by an emulsion layer of a conventional reversal photographic element wherein radiation sensitive tabular silver haloiodide grains are present, but the relatively fine grains are not present. Curve 2 illustrates the reversal characteristic curve produced by the same emulsion layer differing only by the inclusion of the relatively fine grains. It is to be understood that exposure and processing producing both curves are identical. In the toe region 2*a* of the characteristic curve 2 it can be seen that density is lower than in the corresponding toe region 1*a* of the characteristic curve 1. Thus the inventive reversal photographic element produces images having brighter highlights. Comparing the mid-portions 1*b* and 2*b* of the characteristic curves, it can be seen that the characteristic curve of the photographic element according to the invention exhibits significantly higher contrast. Comparing the shoulder portions 1*c* and 2*c* of the characteristic curves, it can be seen that the shoulder portion 2*c* of the characteristic curve of the reversal photographic element satisfying this invention is of much higher density. In comparing the shoulder portions 1*c* and 2*c* of the characteristic curves it can be seen that curve 2 is already declining from maximum density at the minimum exposure level shown while the threshold decline from maximum density of the curve 1 occurs well within the exposure scale. Thus, it can be seen that the reversal threshold speed exhibited by curve 2 exceeds that of curve 1, where reversal threshold speed is defined as the exposure level corresponding to the threshold (first detectable) decline from maximum density of the reversal characteristic curve. Shifting from the language of the photographic scientist to that of the ultimate user, the photographer, the present invention adds speed and "snap" to reversal photographic elements employing radiation sensitive tabular grain emulsions.

The inventive character of the reversal photographic elements herein disclosed is underscored when it is appreciated that highly analogous reversal photographic elements differing in one or more essential features of this invention do not exhibit even qualitatively predictable similarities in performance when the relatively fine grain silver salts are introduced into the reversal photographic elements. Specifically, when the relatively fine grains of silver salt are placed in layers adjacent to rather than in the radiation sensitive tabular grain emulsion layer, the result is a loss in maximum density, a loss of contrast, and an increase in toe region and minimum densities. If a conventional nontabular silver haloiodide emulsion is substituted for the tabular grain emulsion layer, the result is marked reversal desensitization, which necessarily increases toe region density at comparable exposure levels. If relatively fine grain silver iodide is substituted for relatively fine grains exhibiting a higher level of solubility, no enhancement of the characteristic curve shape is observed. Still further, advantageous modifications of reversal characteristic curve shape have been realized only when the radiation sensitive tabular grains are silver haloiodide grains as opposed to tabular silver halide grains lacking iodide as a constituent.

This invention can be better appreciated by reference to the following detailed description considered in conjunction with the drawings, in which FIG. 1 is a schematic diagram intended to compare qualitatitively the reversal characteristic curve 2 of a reversal photographic element according to this invention with the reversal characteristic curve 1 of a reversal photographic element differing only in lacking a second grain population;

FIGS. 2 through 10 present and compare reversal characteristic curves of elements exemplifying this invention, identified by the prefix E before the element number, and comparative elements, identified by the prefix C before the element number.

DESCRIPTION OF PREFERRED EMBODIMENTS

Figure 1:
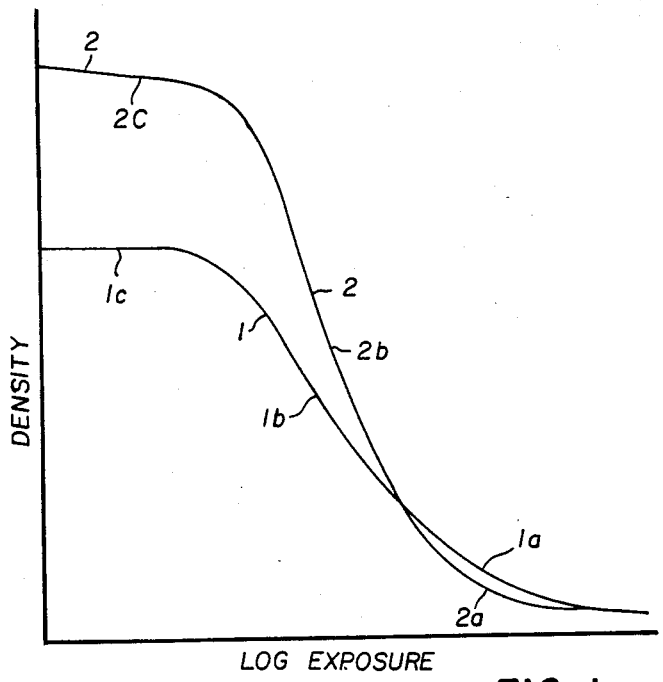

This invention relates to an improvement in silver halide photographic elements useful in reversal imaging. The photographic elements are comprised of a support and one or more image recording silver halide emulsion layers coated on the support. At least one of the image recording emulsion layers contains a dispersing medium and radiation sensitive tabular silver haloiodide grains blended with relatively fine grains consisting essentially of a silver salt more soluble than silver iodide.

Tabular grains are herein defined as those having two substantially parallel crystal faces, each of which is clearly larger than any other single crystal face of the grain. The tabular grains employed in the blended grain emulsion layers forming one or more layers of the reversal photographic elements of this invention are chosen so that the tabular grains having a thickness of less than 0.5 μm have an average aspect ratio of greater than 8:1 and account for at least 35 percent of the total grain projected area of the blended grain emulsion layer in which they are present.

A convenient approach for preparing blended grain emulsion layers satisfying the requirements of this invention is to blend with the relatively fine second grain population a radiation sensitive high aspect ratio tabular grain emulsion. The term "high aspect ratio tabular grain emulsion" is herein defined as requiring that the tabular silver halide grains having a thickness of less than 0.3 μm have an average aspect ratio of greater than 8:1 and account for at least 50 percent of the total projected area of the grains present in the emulsion. The term is thus defined in conformity with the usage of this term in the patents relating to tabular grain emulsions cited above.

In general tabular grains are preferred having a thickness of less than 0.3 μm. Where the emulsion layer is intended to record blue light as opposed to green or red light, it is advantageous to increase the thickness criterion of the tabular grains to less than .0.5 μm, instead of less than 0.3 μm. Such an increase in tabular grain thickness is also contemplated for applications in which the reversal image is to be viewed without enlargement or where granularity is of little importance, although these latter applications are relatively rare in reversal imaging, reversal images being most commonly viewed by projection. Tabular grain emulsions wherein the tabular grains have a thickness of less than 0.5 μm intended for recording blue light are disclosed by Kofron et al U.S. Pat. No. 4,439,520, cited above.

While the tabular grains satisfying the 0.3 μm thickness criterion account for at least 50 percent of the total projected area of the grains in high aspect ratio tabular grain emulsions, it is appreciated that in blending a second grain population the tabular grain percentage of the total grain projected area is decreased. The tabular grain emulsions contemplated for preparing blended grain emulsion layers satisfying the requirements of this invention must be capable of providing tabular grains satisfying the thickness and diameter criteria which also provide at least 35 percent of the total grain projected area in the blended grain emulsion layer. Thus, although the tabular grain emulsions employed in the practice of this invention preferably provide at least 50 percent of the total grain projected area, at least before blending with the second grain population, this is not essential if the 35 percent of the total grain projected area condition noted above in the blended grain emulsion layer is satisfied.

Thus, it is apparent that while high aspect ratio tabular grain emulsions are preferred for preparing the blended grain emulsions and in a highly preferred form the blended grain emulsions are themselves high aspect ratio tabular grain emulsions, this is not necessary in all instances, and departures can actually be advantageous for specific applications. However, for simplicity the ensuing discussion relating to radiation sensitive tabular grain emulsions is directed to the preferred high aspect ratio tabular grain emulsions, it being appreciated that the teachings are generally applicable to tabular grain emulsions as herein defined.

The preferred high aspect ratio tabular grain silver haloiodide emulsions are those wherein the silver haloiodide grains having a thickness of less than 0.3 μm (optimally less than 0.2 μm) have an average aspect ratio of at least 12:1 and optimally at least 20:1. In a preferred form of the invention these silver haloiodide grains satisfying the above thickness and diameter criteria account for at least 70 percent and optimally at least 90 percent of the total projected area of the silver halide grains. In a highly preferred form of the invention the blended grain emulsions required by this invention also satisfy the parameters set out for the preferred high aspect ratio tabular grain emulsions.

It is appreciated that the thinner the tabular grains accounting for a given percentage of the projected area, the higher the average aspect ratio of the emulsion. Typically the tabular grains have an average thickness of at least 0.03 μm, although even thinner tabular grains can in principle be employed.

High aspect ratio tabular grain emulsions useful in the practice of this invention can have extremely high average aspect ratios. Tabular grain average aspect ratios can be increased by increasing average grain diameters. This can produce sharpness advantages, but maximum average grain diameters are generally limited by granularity requirements for a specific photographic application. Tabular grain average aspect ratios can also or alternatively be increased by decreasing average grain thicknesses. When silver coverages are held constant, decreasing the thickness of tabular grains generally improves granularity as a direct function of increasing aspect ratio. Hence the maximum average aspect ratios of the tabular grain emulsions of this invention are a function of the maximum average grain diameters acceptable for the specific photographic application and the minimum attainable tabular grain thicknesses which can be conveniently produced. Maximum average aspect ratios have been observed to vary, depending upon the precipitation technique employed and the tabular grain halide composition. High aspect ratio tabular grain silver haloiodide emulsions with average aspect ratios of 100:1, 200:1, or even higher are obtainable by double-jet precipitation procedures.

The tabular haloiodide grains employed in the practice of this invention contain in addition to iodide at least one of bromide and chloride. Thus, the silver haloiodides specifically contemplated are silver bromoiodides, silver chlorobromoiodides, and silver chloroiodides. Silver bromoiodide emulsions generally exhibit higher photographic speeds and are for this reason the preferred and most commonly employed emulsions for candid photography.

Iodide must be present in the tabular silver haloiodide grains in a concentration sufficient to influence photographic performance. It is thus contemplated that at least about 0.5 mole percent iodide will be present in the tabular silver haloiodide grains. However, high levels of iodide are not required to achieve the advantages of this invention. Generally the tabular silver haloiodide grains contain less than 8 mole percent iodide. Preferred iodide levels in the tabular silver haloiodide grains are from 1 to 7 mole percent and optimally are from 2 to 6 mole percent. All of the above iodide mole percentages are based on total silver present in the tabular grains.

The radiation sensitive tabular haloiodide grains required for the practice of this invention are preferably provided by selecting from among the various high aspect ratio tabular grain emulsions disclosed in *Research Disclosure* Vol. 225, Jan. 1983, Item 22534; Wilgus et al U.S. Pat. No. 4,434,226; Kofron et al U.S. Pat. No. 4,439,520; Solberg et al U.S. Pat. No. 4,433,048; Maskasky U.S. Pat. No. 4,400,463; and Maskasky U.S. Pat. No. 4,435,501; each cited above, which disclose high aspect ratio tabular grain emulsions wherein tabular silver haloiodide grains having a thickness of less than 0.5 μm (preferably 0.3 μm and optimally 0.2 μm), a diameter of at least 0.6 μm, and an average aspect ratio of greater than 8:1 (preferably at least 12:1 and optimally at least 20:1) account for at least 50 (preferably 70 and optimally 90) percent of the total grain projected area.

Daubendiek U.S. Ser. Nos. 790,692 and 790,693, filed Oct. 23, 1985, titled MULTICOLOR PHOTOGRAPHIC ELEMENTS (I) and (II), respectively, refiled Apr. 1, 1986 as U.S. Ser. Nos 891,803 and 891,804, respectively, commonly assigned, disclose haloiodide emulsions, specifically bromoiodide emulsions, having a mean diameter in the range of from 0.2 to 0.55 μm including tabular grains having an aspect ratio of greater than 8:1 (preferably at least 12:1) accounting for at least 50 (preferably 70 and optimally 90) percent of the total grains in the emulsion layer. These emulsions are disclosed to exhibit low levels of light scattering when coated over one or more remaining imaging layers. Preparation of these emulsions is illustrated by the emulsion preparation included in the Appendix. Once the basic precipitation procedure is appreciated, adjustment of other preparation parameters can, if desired, be undertaken by routine optimization techniques.

The blended grain emulsion required for the practice of this invention can be conveniently provided by blending with a tabular grain silver haloiodide emulsion as described above a second grain population consisting essentially of silver salt which is more soluble than silver iodide. The silver salt should be sufficiently insoluble that it is capable of forming a grain rather than being present in a solubilized form. Useful silver salts can be chosen from among those having a solubility product constant in the range 9.5 to less than 16. Preferred silver salts are those having a solubility product constant in the range of from 9.75 to 15.5, optimally from 11 to 13. Unless otherwise stated, all solubility product constants are referenced to a temperature of 20° C. A discussion and listing of solubility product constants for exemplary silver salts is presented by James, *Theory of the Photographic Process*, 4th Ed., Macmillan, 1977, Chapter 1, Sections F, G, and H, pp. 5–10.

It is preferred that the silver salt forming the relatively fine grains be at least as soluble as the most soluble silver halide present in the radiation sensitive tabular grains. For example, when the tabular grains consist essentially of silver chlorobromoiodide, the relatively fine grains preferably consist essentially of silver chloride or silver chlorobromide as opposed to silver bromide. When radiation sensitive tabular silver bromoiodide grains are employed, the relatively fine grains preferably consist essentially of silver bromide, silver thiocyanate, or a combination of both. Advantages have been realized when silver bromide and silver thiocyanate grains are employed in combination.

Although the relatively fine grains consist essentially of silver salt more soluble than silver iodide, it is appreciated that less soluble silver salts in small quantities that do not interfere with effectiveness can be present. For example, it is common to treat silver halide emulsions with soluble iodide salt solutions in conjunction with spectral sensitization and to employ as antifoggants and stabilizers compounds which form highly insoluble silver salts. While such conventional treatments can result in the adsorption of small quantities of silver iodide or one or more other highly insoluble silver salts to the surfaces of the relatively fine grains, such conventional emulsion treatments are not normally incompatible with the practice of this invention. In all instances the relatively fine grains contain less iodide than said tabular grains. In other words, iodide ions account for a lower proportion of the relatively fine grains than the silver haloiodide tabular grains.

The grains consisting essentially of a silver salt more soluble than silver iodide are fine as compared to the tabular silver haloiodide grains. In general, the permissible size of this second grain population blended with the radiation sensitive tabular grains is a direct function of the solubility of the silver salt forming these grains. The second grain population in all instances exhibits an average grain diameter less than that of the tabular silver haloiodide grains and less than 0.5 μm. The second grain population preferably exhibits an average grain diameter of less than 0.3 μm. Optimally the second grain population exhibits an average grain diameter of less than 0.1 μm. Thus, the second grain population is optimally provided by blending a conventional Lippmann emulsion with the radiation sensitive tabular grain emulsion to produce the blended grain emulsion required for the practice of this invention. The minimum average diameter of the second grain population is limited only by synthetic convenience, typically being at least about 0.05 μm.

Any concentration of the second grain population can be employed that is capable of enhancing the photographic properties (e.g., speed and contrast) of the reversal photographic elements. Minimum second grain population concentrations can range from as low as about 0.5 mole percent, based on total silver in the blended grain emulsion layer, with concentrations above about 1 mole percent being preferred and concentrations above about 5 mole percent being optimum for maximizing photographic benefits. To avoid inefficient use of silver salts maximum concentrations of the second grain population are generally maintained below the concentrations of the silver haloiodide forming the radiation sensitive tabular grains—that is, below 50 mole percent, based on total silver in the blended grain emulsion layer, with most efficient utilization of silver occurring at second grain concentrations below about 40 mole percent.

It is an important feature of the invention that the second grain population is incapable of forming a latent image extending the exposure latitude imparted to the emulsion layer by the tabular grains. When the tabular grains have received sufficient light exposure to reach their maximum level of developability, the second grain population has not yet reached a threshold exposure for producing a latent image. The second grain population need not be capable of forming a latent image at any level of exposure, since the latent image forming capability of the second grain population is not utilized in enhancing reversal imaging characteristics. However a second grain population having a latent image forming capability is not excluded from the practice of the invention, provided its threshold exposure level is beyond the intended exposure latitude of the photographic element. Thus, the second grain population preferably requires at least 0.3 log E greater exposure than that required to bring the tabular grains to a maximum level of developability. The relative of insensitivity of the second grain population to exposing radiation as compared to the tabular grains can result from the difference in their mean diameters, the tabular grains in all instances having the larger mean diameter. In most instances and preferably the difference in radiation sensitivity of the two grain populations is increased by chemically sensitizing and/or spectrally sensitizing the only the tabular grains. Although not required, conventional techniques for desensitizing the second grain population can, if desired, be employed. Zelikman et al *Making and Coating Photographic Emulsions,* Focal Press, 1964, pp. 234–237, illustrate the concept of extending exposure latitude.

It is generally most convenient to prepare the emulsions required for the practice of this invention by blending a tabular silver haloiodide grain emulsion, preferably after sensitization, and a separately prepared emulsion containing the relatively fine second grain population. The relatively fine grain emulsion can, for example, take the form of a relatively fine grain silver chloride, silver bromide, or silver thiocyanate emulsion, the preparations of which are well known to those skilled in the art and form no part of this invention. As previously, noted the relatively fine grain emulsion is optimally a Lippmann emulsion. So long as the grain requirements identified above are satisfied, either or both of the tabular grain containing and relatively fine grain containing emulsions can themselves be the product of conventional grain blending.

Apart from the blended grain emulsion features specifically described above the reversal photographic elements of this invention can take any convenient conventional form. The reversal photographic elements can take the form of either black-and-white or color reversal photographic elements.

In a very simple form the reversal photographic elements according to this invention can be comprised of a conventional photographic support, such as a transparent film support, onto which is coated a blended grain emulsion layer as described above. Although conventional overcoat and subbing layers are preferred, only the blended grain emulsion layer is essential. Following imagewise exposure, silver halide is imagewise developed to produce a first silver image, which need not be viewable. The first silver image can be removed by bleaching before further development when a silver or silver enhanced dye reversal image is desired. Thereafter, the residual silver halide is uniformly rendered developable by exposure or by fogging. Development produces a reversal image. The reversal image can be either a silver image, a silver enhanced dye image, or a dye image only, depending upon the specific choice of conventional processing techniques employed. The production of silver reversal images is described by Mason, *Photographic Processing Chemistry,* 1966, Focal Press Ltd., pp. 160–161. If a dye only image is being produced, silver bleaching is usually deferred until after the final dye image is formed.

The reversal photographic elements of this invention are in a preferred form color reversal photographic elements capable of producing multicolor images—e.g., images that at least approximately replicate subject colors. Illustrative of such color reversal photographic elements are those disclosed by Kofron et al U.S. Pat. No. 4,439,520 and Groet U.S. Pat. No. 4,082,553, each cited above and here incorporated by reference. In a simple form such a color reversal photographic element can be comprised of a support having coated thereon at least three color forming layer units, including a blue recording yellow dye image forming layer unit, a green recording magenta dye image forming layer unit, and a red recording cyan dye image forming layer unit. Each color forming layer unit is comprised of at least one radiation sensitive silver halide emulsion layer. In a preferred form of the invention at least one radiation sensitive emulsion layer in each color forming layer unit is comprised of a blended grain emulsion as described above. The blended grain emulsions in each color forming layer unit can be chemically and spectrally sensitized as taught by Kofron et al U.S. Pat. No. 4,439,520. In a preferred form chemical and spectral sensitization of the tabular grain emulsion is completed before blending with the second grain population, which therefore remains substantially free of sensitizing materials. One or more dye image providing materials, such as couplers, are preferably incorporated in each color forming layer unit, but can alternatively be introduced into the photographic element during processing.

The following constitutes a specific illustration of a color reversal photographic element according to this invention:

I. Photographic Support

Exemplary preferred photographic supports include cellulose acetate and poly(ethylene terephthalate) film supports and photographic paper supports, especially a paper support which is partially acetylated or coated with baryta and/or α-olefin polymer, particularly a polymer of an α-olefin containing 2 to 10 carbon atoms, such as polyethylene, polypropylene, and ethylenebutene copolymers.

II. Subbing Layer

To facilitate coating on the photographic support it is preferred to provide a gelatin or other conventional subbing layer.

III. Red Recording Layer Unit

At least one layer comprised of a red sensitized blended grain high aspect ratio tabular grain silver haloiodide emulsion layer, as described in detail above. In an emulsion layer or in a layer adjacent thereto at least one conventional cyan dye image forming coupler is included, such as, for example, one of the cyan dye image forming couplers disclosed in U.S. Pat. Nos 2,423,730; 2,706,684; 2,725,292, 2,772,161; 2,772,162; 2,801,171; 2,895,826; 2,908,573; 2,920,961; 2,9767,146; 3,002,836; 3,034,892; 3,148,062, 3,214,437; 3,227,554; 3,253,924; 3,311,476; 3,419,390; 3,458,315; and 3,476,563.

IV. Interlayer

At least one hydrophilic colloid interlayer, preferably a gelatin interlayer which includes a reducing agent, such as an aminophenol or an alkyl substituted hydroquinone, is provided to act as an oxidized developing agent scavenger.

V. Green Recording Layer Unit

At least one layer comprised of a green sensitized blended grain high aspect ratio tabular grain silver haloiodide emulsion layer, as described in detail above. In an emulsion layer or in a layer adjacent thereto at least one conventional magenta dye image forming coupler is included, such as, for example, one of the magenta dye image forming couplers disclosed in U.S. Pat. Nos 2,725,292; 2,772,161; 2,895,826; 2,908,573; 2,920,961; 2,933,391; 2,983,608; 3,005,712; 3,006,759; 3,062,653; 3,148,062; 3,152,896; 3,214,437; 3,227,554; 3,253,924; 3,311,476; 3,419,391; 3,432,521; and 3,519,429.

VI. Yellow Filter Layer

A yellow filter layer is provided for the purpose of absorbing blue light. The yellow filter layer can take any convenient conventional form, such as a gelatino-yellow colloidal silver layer (i.e., a Carey Lea silver layer) or a yellow dye containing gelatin layer. In addition the filter layer contains a reducing agent acting as an oxidized developing agent scavenger, as described above in connection with the Interlayer IV.

VII. Blue Recording Layer Unit

At least one layer comprised of a blue sensitized blended grain high aspect ratio tabular grain silver haloiodide emulsion layer, as described in detail above. In an alternative form the tabular grains can be thicker than high aspect ratio tabular grains—that is, the thickness criteria for the grains can be increased from 0.3 μm to less than 0.5 μm, as described above. In this instance the grains exhibit more native blue speed, which preferably is augmented by the use of blue spectral sensitizers, although this is not essential, except for the highest attainable blue speeds. In an emulsion layer or in a layer adjacent thereto at least one conventional yellow dye image forming coupler is included, such as, for example, one of the yellow dye image forming couplers disclosed in U.S. Pat. Nos. 2,875,057; 2,895,826; 2,908,573; 2,920,961; 3,148,062; 3,227,554; 3,253,924; 3,265,506; 3,277,155; 3,369,895; 3,384,657; 3,408,194; 3,415,652; and 3,447,928.

VIII. Overcoat Layer

At least one overcoat layer is provided. Such layers are typically transparent gelatin layers and contain known addenda for enhancing coating, handling, and photographic properties, such as matting agents, surfactants, antistatic agents, ultraviolet absorbers, and similar addenda.

As disclosed by Kofron et al U.S. Pat. No. 4,439,520, the high aspect ratio tabular grain emulsion layers show sufficient differences in blue speed and green or red speed when substantially optimally sensitized to green or red light that the use of a yellow filter layer is not required to achieve acceptable green or red exposure records. It is appreciated that in the absence of a yellow filter layer the color forming layer units can be coated in any desired order on the support. While only a single color forming layer unit is disclosed for recording each of the blue, green, and red exposures, it is appreciated that two, three, or even more color forming layer units can be provided to record any one of blue, green, and red. It is also possible to employ within any or all of the blue, green, and red color forming layer units multiple radiation sensitive emulsion layers any, some, or all of which satisfy the blended grain emulsion requirements of this invention.

In addition to the features described above the reversal photographic elements can, of course, contain other conventional features known in the art, which can be illustrated by reference to *Research Disclosure,* Vol. 176, Dec. 1978, Item 17643, here incorporated by reference. For example, the silver halide emulsions other than the blended grain emulsions described can be chosen from among those described in Paragraph I; the silver halide emulsions can be chemically sensitized, as described in Paragraph III and/or spectrally sensitized, as described in Paragraph IV, although preferably only the tabular grain silver haloiodide emulsions are sensitized, with the preferred sensitizations those disclosed by Kofron et al U.S. Pat. No.4,439,520 and Maskasky U.S. Pat. No. 4,435,501; any portion of the elements can contain brighteners, as described in Paragraph V; the emulsion layers can contain antifoggants and stabilizers, as described in Paragraph VI; the color forming layer units can contain color image forming materials as described in Paragraph VII; the elements can contain absorbing and scattering materials, as described in Paragraph VIII; the emulsion and other layers can contain vehicles, as described in Paragraph IX; the hydrophilic colloid and other layers of the elements can contain hardeners, as described in Paragraph X; the layers can contain coating aids, as described in Paragraph XI; the layers can contain plasticizers and lubricants, as described in Paragraph XII; the layers, particularly the layers coated farthest from the support, can contain matting agents, as described in Paragraph XVI; and the supports can be chosen from among those described in Paragraph XVII. This exemplary listing of addenda and features is not intended to restrict or imply the absence of other conventional photographic features compatible with the practice of the invention.

The photographic elements can be imagewise exposed with any of various forms of energy, as illustrated by *Research Disclosure,* Item 17643, cited above, Paragraph XVIII. For multicolor imaging the photographic elements are exposed to visible light.

Multicolor reversal dye images can be formed in photographic elements according to this invention having differentially spectrally sensitized silver halide emulsion layers by black-and-white development followed by color development. Reversal processing is demonstrated below employing conventional reversal processing compositions and procedures.

EXAMPLES

The invention can be better appreciated by reference to the following specific examples. Coverages in parenthesis are expressed in grams per square meter. The elements described were in each instance, except as otherwise stated, exposed through a step tablet for 0.02 second by a 500 watt 2850° K. light source through a Wratten 8 ® filter and reversal processed with a 3 minute first development step using the Kodak E-6 ® process. The Kodak E-6 ® process is described in the *British Journal of Photography Annual,* 1982, pp. 201–203.

Element 1 (satisfying the invention)

The following layers were coated on a film support in the order recited:

Layer 1

Gelatin (1.08)

Layer 2

A very high speed green sensitized high aspect ratio tabular grain silver bromoiodide emulsion consisting of (a) high aspect ratio tabular bromoiodide grains (1.08) having an average aspect ratio of 18:1, an average tabular grain thickness of 0.1 μm, and a bromide to iodide mole ratio of 97:3; (b) 0.08 μm silver bromide grains (0.86) provided by blending a Lippmann emulsion with a high aspect ratio tabular grain silver bromoiodide emulsion providing the grains for (a); (c) gelatin (2.16); and (d) a magenta dye forming coupler, 1-(2,4,6-trichlorophenyl)-3-β -[α-(2,4,-di-tert-amylphenoxy)acetamido]benzamido L-5-pyrazolone (0.86).

Layer 3

Gelatin (1.08) and bis(vinylsulfonyl)methane hardener at 1.75% by weight, based on total gelatin in all layers.

Element 2 (not satisfying the invention)

Element 2 was identical to Element 1, except that no Lippmann emulsion was blended to form Layer 2.

Element 3 (not satisfying the invention)

Element 3 was identical to Element 1, except that the Lippmann emulsion was not blended in Layer 2, but was partitioned into two equal parts blended into Layers 1 and 3.

Figure 2:
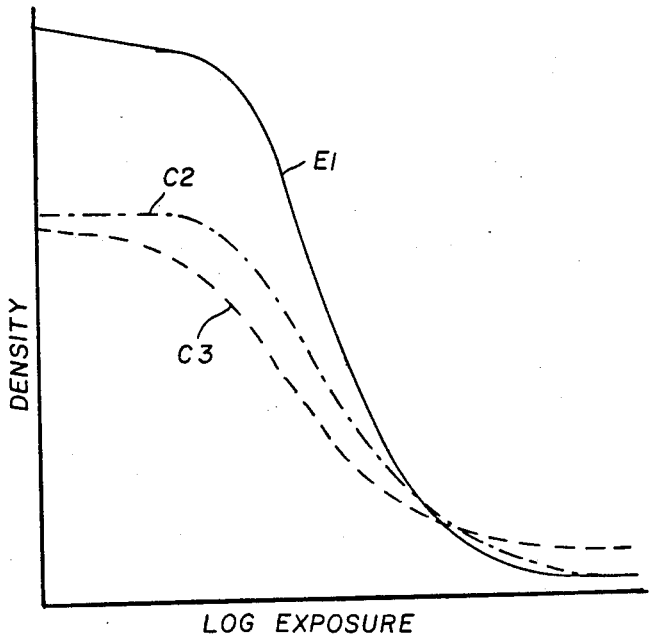

The photographic performance of the color reversal photographic elements can be compared by reference to FIG. 2, which shows the characteristic curves for Elements 1, 2, and 3 as curves E1, C2, and C3, respectively. In comparing curve E1 with curves C2 and C3 it can be seen that a higher maximum density and contrast is realized and that a lower density in the toe region of the curve E1 is realized. It is surprising that the partitioning of the silver bromide Lippmann emulsion between the overcoat and undercoat layers degrades photographic performance so that lower maximum density and contrast as well as a higher minimum density are observed than when the Lippmann emulsion is entirely absent. Further, it is highly surprising that the partitioned Lippmann emulsion produces a result just the opposite of that produced by blending the Lippmann emulsion with the high aspect ratio tabular grain silver bromoiodide emulsion.

Element 4 (not satisfying the invention)

An element identical to Element 1 was prepared, except that instead of blending a high aspect ratio tabular grain emulsion with the silver bromide Lippmann emulsion (a) a single jet precipitated, ammonia digested silver bromoiodide emulsion containing nontabular grains of 0.54 μm in mean diameter and a bromide to iodide mole ratio of 96.5:3.4 was substituted for the high aspect ratio tabular grain silver bromoiodide emulsion and (b) the coating coverage of the silver bromide grains was reduced to 0.43 g/m$^2$.

Element 5 (not satisfying the invention)

Element 5 was identical to Element 4, except that no Lippmann emulsion was blended to form Layer 2.

Element 6 (not satisfying the invention)

Element 6 was identical to Element 4, except that the Lippmann emulsion coverage was increased to 0.86 g/m$^2$ and was not blended in Layer 2, but was partitioned into two equal parts blended into Layers 1 and 3.

Figure 3:
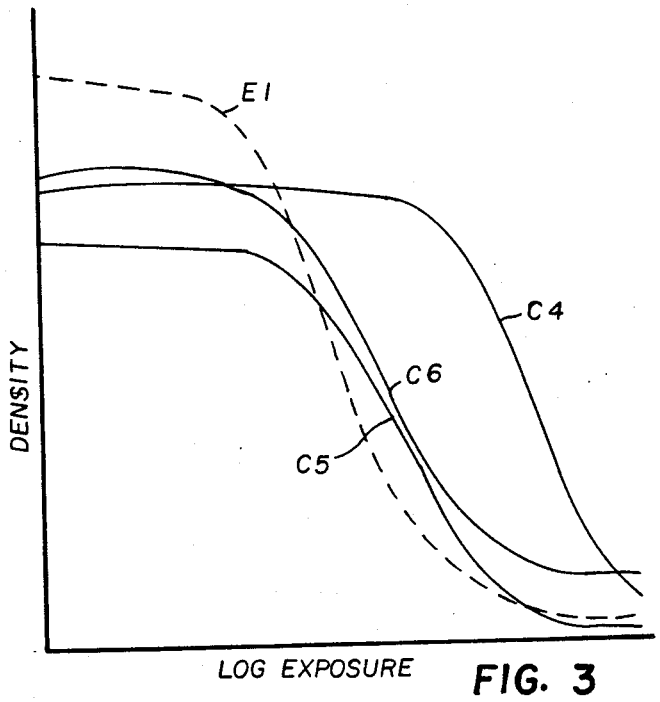

The photographic performance of the color reversal photographic elements can be compared by reference to FIG. 3, which shows the characteristic curves for Elements 4, 5, and 6 as curves C4, C5, and C6, respectively. In comparing the performance of the elements it is apparent that the blending of the Lippman silver bromide grains in the nontabular silver bromoiodide emulsion had the effect of markedly reducing the speed of Element 4 as compared to Element 1, presented by the dashed line curve E1, or Elements 5 and 6, represented by curves C5 and C6. It can be seen that inclusion of the Lippmann silver bromide emulsion in Layer 2 of Element 4 resulted in an increase in maximum density and a slight increase in contrast as compared to Element 5, but the large loss of speed prevented any decrease in toe region density from being obtained. It is to be further noted that the relationship of curves C5 and C6 is reversed from that expected from the relationship of curves C2 and C3.

Element 7 (not satisfying the invention)

Element 7 was identical to Element 4, except that the single jet ammonia digested silver bromoiodide emulsion exhibited a bromide to iodide mole ratio of 93.7:6.3 and a mean grain diameter of 0.70 μm.

Element 8 (not satisfying the invention)

Element 8 was identical to Element 7, except that no Lippmann emulsion was blended to form Layer 2.

Element 9 (not satisfying the invention)

Element 9 was identical to Element 7, except that the Lippmann emulsion coverage was increased to 0.86 $g/m^2$ and was not blended in Layer 2, but was partitioned into two equal parts blended into Layers 1 and 3.

Figure 4:
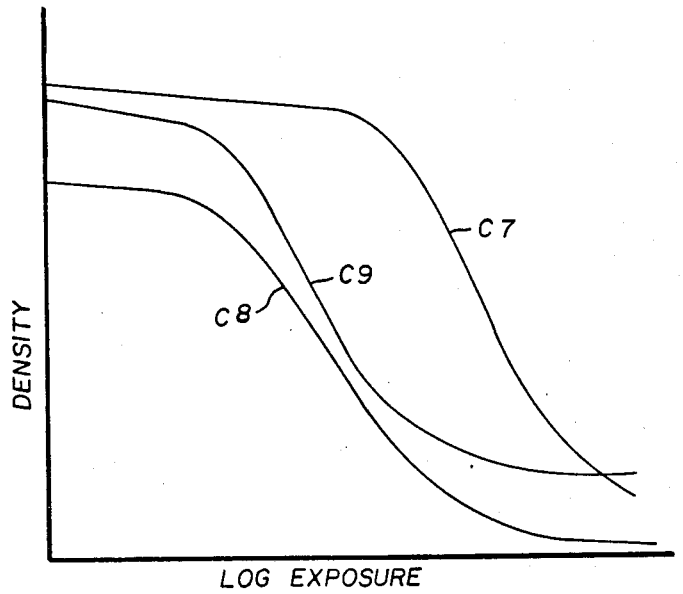

The performance of Elements 7, 8, and 9 is represented by curves C7, C8, and C9 in FIG. 4. In comparing the curves of FIGS. 3 and 4, it is apparent that the relative performance of Elements 7, 8, and 9 is similar to that of Elements 4, 5, and 6, respectively.

Element 10 (not satisfying the invention)

The following layers were coated on a transparent film support in the order recited:

Layer 1

A very high speed green sensitized high aspect ratio tabular grain silver bromoiodide emulsion consisting of (a) high aspect ratio tabular bromoiodide grains having an average aspect ratio of 18:1, an average tabular grain thickness of 0.1 μm, and a bromide to iodide mole ratio of 97:3 (1.08); (b) gelatin (2.16); and (c) a cyan dye forming coupler, 3-[α-(2,4,-di-tert-amylphenoxy)hexanamido]-2-heptafluorobutyramidophenol (0.97).

Layer 2

Gelatin (0.97) and bis(vinylsulfonyl)methane hardener at 1.75% by weight, based on total gelatin in both layers.

Element 11 (satisfying the invention)

Element 11 was identical to Element 10, except that 0.054 $g/m^2$ of 0.08 μm silver bromide grains in the form of a Lippmann emulsion were blended with the high aspect ratio tabular grain silver bromoiodide emulsion.

Element 12 (satisfying the invention)

Element 12 was identical to Element 11, except that the coating coverage of the silver bromide grains was approximately doubled to 0.11 $g/m^2$.

Element 13 (satisfying the invention)

Element 13 was identical to Element 12, except that the coating coverage of the silver bromide grains was doubled to 0.22 $g/m^2$.

Figure 5:
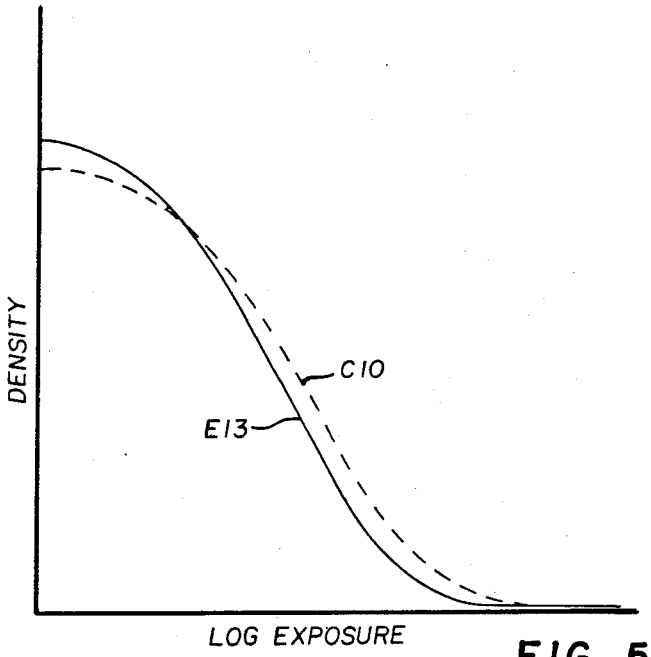

The performances of Element 10, represented by curve C10, and Element 13, represented by curve E13, are compared in FIG. 5. It is apparent that curve E13 demonstrates a higher maximum density, threshold speed, and contrast and a lower toe region density. Elements 11 and 12 exhibited performances intermediate between those of Elements 10 and 13, except that Element 11 exhibited a lower maximum density and no higher contrast than Element 10. However, when the characteristic curves were translated to a superposed position at minimum exposure (at the left hand edge of the plot), it was apparent that the threshold speed and contrast increased progressively as a direct function of Lippmann emulsion inclusion, with Element 10 exhibiting the lowest threshold speed and contrast and Element 13 exhibiting the highest threshold speed and contrast.

Elements 14 through 17

Figure 6:
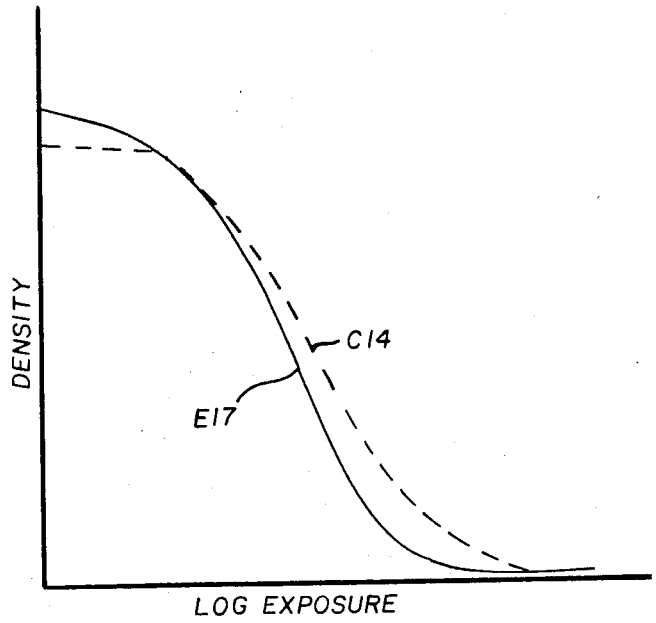

The comparison described above with reference to Elements 10 through 13 was repeated, but with 0.2 to 0.4 μm silver thiocyanate grains being substituted for the silver bromide grains. Silver thiocyanate concentrations are listed in Table I. The results for Element 14, represented by curve C14, and Element 17, represented by curve E17, are shown in FIG. 6. Intermediate performances were exhibited by Elements 15 and 16. Element 14 does not satisfy the requirements of the invention while elements 15 through 17 do satisfy the requirements of the invention.

TABLE I

| Element | Curve | AgSCN ($g/m^2$) |
|---|---|---|
| 14 | C14 | None |
| 15 | — | 0.055 |
| 16 | — | 0.11 |
| 17 | E17 | 0.22 |

Element 18 (not satisfying the invention)

The following layers were coated on a transparent film support in the order recited:

Layer 1

A very high speed green sensitized high aspect ratio tabular grain silver bromoiodide emulsion consisting of (a) high aspect ratio tabular bromoiodide grains having an average aspect ratio of 18:1, an average tabular grain thickness of 0.1 μm, and a bromide to iodide mole ratio of 97:3 (1.08); (b) gelatin (2.16); and (c) a cyan dye forming coupler, 3-[α-(2,4,-di-tert-amylphenoxy)hexanamido]-2-heptafluorobutyramidophenol (0.97).

Layer 2

A yellow filter layer comprised of gelatin (0.60); α-cyano-4-[N,N-bis(isopropoxycarbonylmethyl)]-amino-2-methyl-4'-methanesulfonamidochalcone (0.11); and α-cyano-4-[N-ethyl-N-(2,2,2-trifluoroethoxycarbonylmethyly]amino-2-methyl-4'-propanesulfonamidochalcone (0.08).

Layer 3

A very high speed blue sensitized high aspect ratio tabular grain silver bromoiodide emulsion consisting of (a) high aspect ratio tabular bromoiodide grains (1.08) having an average aspect ratio of 11.7:1, an average tabular grain thickness of 0.12 μm, and a bromide to iodide mole ratio of 97:3; (b) gelatin (2.16); and (c) a yellow dye forming coupler, α-[4-(4-benzyloxyphenylsulfonyl)phenoxy]-α-pivalyl-2-chloro-5-hexadecylsulfonamidoacetanalide (1.61).

Layer 4

Ultraviolet absorbers 3-(di-n-hexylamino)allylidenemalonitrile (0.11) and n-propyl-α-cyano-p-methoxycinnamate (0.11), 0.08 μm silver bromide grains (0.12), gelatin (1.36), and bis(vinylsulfonyl)methane hardener at 1.75% by weight, based on total gelatin in all layers.

Elements 19 and 20 (satisfying the invention)

Elements 19 and 20 were identical to Element 18, except that the green sensitized high aspect ratio tabular grain emulsion forming Layer 1 also contained 0.11 and 0.22 g/m$^2$ , respectively, of 0.08 μm silver bromide grains, introduced by blending a Lippmann emulsion. The time of development was four minutes 30 seconds.

Figure 7:
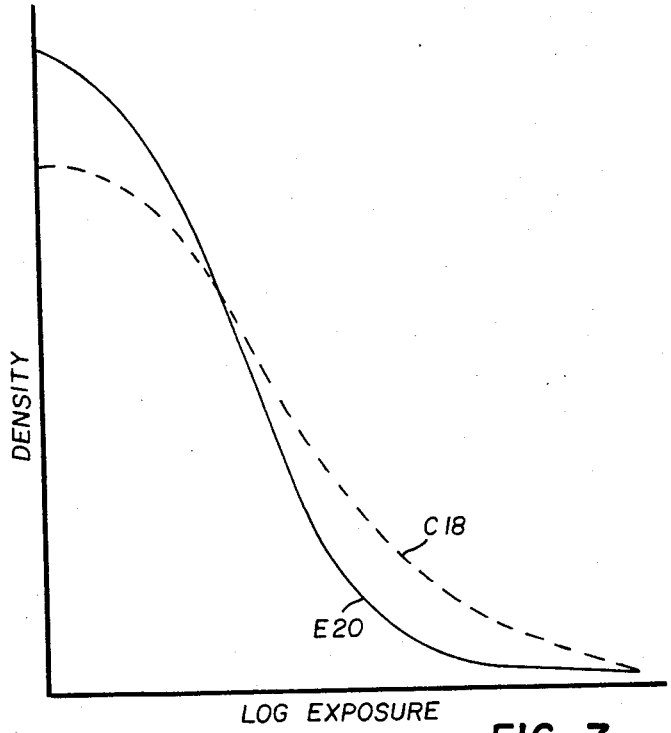

The performances of Element 18, represented by reversal characteristic curve C18, and Element 20, represented by reversal characteristic curve E20, are compared in FIG. 7. A very pronounced increase in maximum density, threshold speed, and contrast and a very pronounced decease in toe region density is observed for Element 20. The performance of Element 19 was intermediate between that of Elements 18 and 20, but nearer to that of Element 20.

Elements 21 and 22 (satisfying the invention)

Elements 21 and 22 were identical to Element 18, except that the green sensitized high aspect ratio tabular grain emulsion forming Layer 1 also contained 0.054 and 0.11 g/m$^2$, respectively, of 0.2-0.4μm average diameter silver thiocyanate grains.

Figure 8:
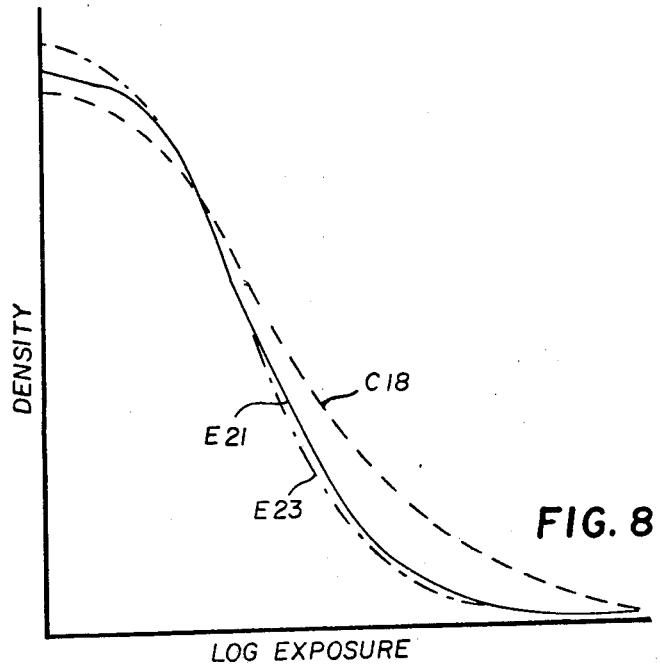

In FIG. 8 the reversal characteristic curve E21 of Element 21 is compared with the reversal characteristic curve C18 of Element 18. It can be seen that maximum density and contrast are higher for Element 21 than for Element 18. Element 21 exhibits a much lower density in the toe region of the curve than Element 18.

Element 22, which contained approximately twice the coating coverage of silver thiocyanate grains exhibited differences from Element 18 that were qualitatively similar to those exhibited by Element 21, but the differences were larger in the case of Element 22.

Element 23 (satisfying the invention)

Element 23 was identical to Element 18, except that the green sensitized high aspect ratio tabular grain emulsion forming Layer 1 also contained 0.11 g/m$^2$ of 0.2–0.4 μm average diameter silver thiocyanate grains and 0.22 g/m$^2$ of 0.08 μm silver bromide grains.

The reversal characteristic curve E23 obtained for Element 23 is plotted in FIG. 8. It can be seen that a higher maximum density and contrast is realized as compared to corresponding curves C18 and E21 representing Elements 18 and 21, respectively. Also a lower toe region density is realized.

Element 24 (not satisfying the invention)

An element similar to Element 14 was prepared, exposed, and processed, except that the emulsion layer additionally contained silver iodide grains of less than 0.1 μm in average diameter (0.11) as a result of blending in a Lippmann silver iodide emulsion.

Figure 9:
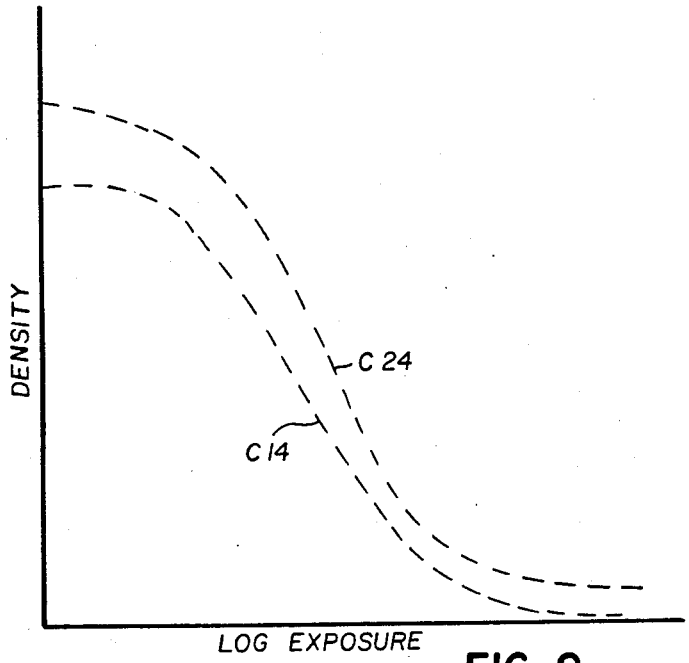

The characteristic curves from Element 14, Curve C14, and Element 24, Curve C24, are compared in FIG. 9. From FIG. 9 it is apparent that the addition of the fine silver iodide grains resulted in an incremental increase in density at all levels of exposure. Reduced toe region density was not obtained, contrast increase was marginal, and minimum density was increased. Thus, the advantages of the invention are not realized by substituting silver iodide grains.

Element 25 (not satisfying the invention)

A control element was made by coating a sulfur and gold chemically sensitized high speed red spectrally sensitized high aspect ratio tabular grain silver bromoiodide emulsion on a gelatin (4.89) subbed film support. The tabular silver bromoiodide grains had an average diameter of 1.6 μm and an average thickness of 0.11 μm. The silver coverage was 1.46 g/m$^2$ and the gelatin coverage of the emulsion layer was 2.15 g/m$^2$. The emulsion layer was overcoated with gelatin (0.98), and the element was hardened with 1.57 percent by weight, based on total gelatin, bis(vinylsulfonyl)methane. The film support had a process removable carbon containing antihalation layer of the type disclosed in Simmons U.S. Pat. No. 2,327,828.

Element 26 (satisfying the invention)

An element was prepared similar to Element 25, except that the silver coverage was increased 5 percent by weight by blending into the silver bromoiodide emulsion before coating a Lippmann emulsion having silver bromide grains of 0.08 μm average diameter.

Element 27 (satisfying the invention)

An element was prepared similar to Element 25, except that the silver coverage was increased 10 percent by weight by blending into the silver bromoiodide emulsion before coating a Lippmann emulsion having silver bromide grains of 0.08 μm average diameter.

Element 28 satisfying the invention)

An element was prepared similar to Element 25, except that the silver coverage was increased 20 percent by weight by blending into the silver bromoiodide emulsion before coating a Lippmann emulsion having silver bromide grains of 0.08 μm average diameter.

Elements 25, 26, 27, and 28 were identically exposed and processed. The dried elements were exposed (1/50 second, 500 watts/2850° K.) through a 0.61 neutral density filter and a Daylight V filter plus a Wratten 23A ® filter. After removal of the antihalation layer, the elements were processed for 80 seconds in a black-and-white developer of the type disclosed by Battaglini et al U.S. Pat. No. 3,607,263, Example 1, washed, exposed uniformly to red light, and processed in color developer containing a cyan coupler, following a procedure like that of Example 1 of Schwan et al U.S. Pat. No. 2,959,970.

Figure 10:
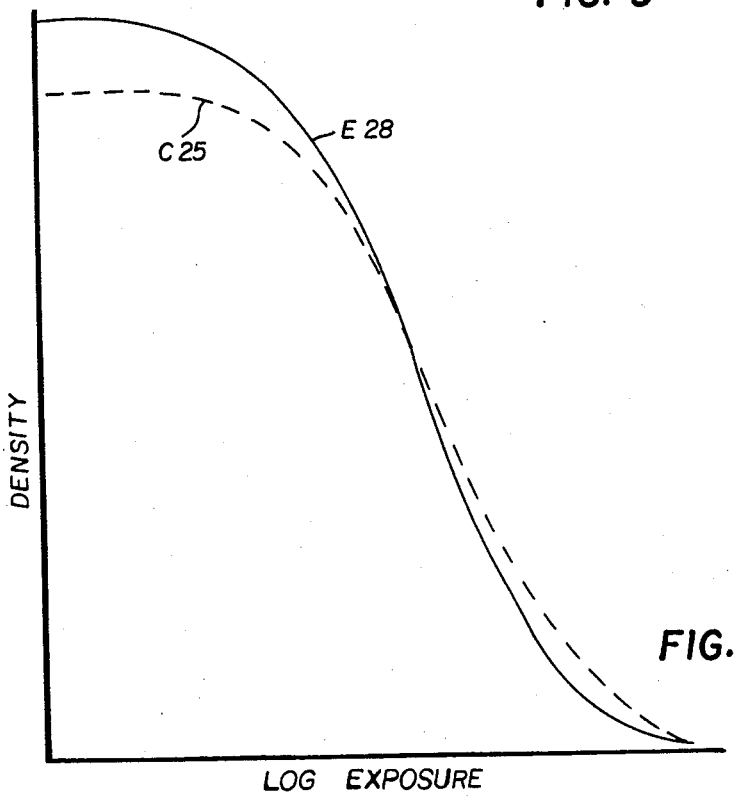

The characteristic curves obtained for Elements 25 and 28 are shown in FIG. 10 as curves C25 and E28, respectively. It can be seen that curve E28 has a higher maximum density and contrast than curve C25 and exhibits reduced density in the toe region of the characteristic curve. The characteristic curves for Elements 26 and 27, not shown, fell between the characteristic curves C25 and E28, but nearer to E28.

APPENDIX

Preparation of Reduced Diameter High Aspect Ratio Tabular Grain Emulsion

To a reaction vessel equipped with efficient stirring was added 3.0 L of a solution containing 7.5 g of bone gelatin. The solution also contained 0.7 mL of an antifoaming agent. The pH was adjusted to 1.94 at 35° C. with $H_2SO_4$ and the pAg to 9.53 by the addition of an aqueous potassium bromide solution. To the vessel was simultaneously added over a period of 12 s a 1.25 M solution of $AgNO_3$ and a 1.25 M solution of KBr+KI (94:6 mole percent) at a constant rate, consuming 0.02 moles Ag. The temperature was raised to 60° C. (5°

C./3 min) and 66 g of bone gelatin in 400 mL of water was added. The pH was adjusted to 6.00 at 60° C. with NaOH, and the pAg to 8.88 at 60° C. with KBr. Using a constant flow rate, the precipitation was continued with the addition of a 0.4 M $AgNO_3$ solution over a period of 24.9 min. Concurrently at the same rate was added a 0.0121 M suspension of an AgI emulsion (about 0.05 μm grain size; 40 g/Ag mole bone gelatin). A 0.4 M KBr solution was also simultaneously added at the rate required to maintain the pAg at 8.88 during the precipitation. The $AgNO_3$ provided a total of 1.0 mole Ag in this step of the precipitation, with an additional 0.03 mole Ag being supplied by the AgI emulsion. The emulsion was coagulation washed by the Procedure of Yutzy, et al., U.S. Pat. No. 2,614,929.

The equivalent circular diameter of the mean projected area of the grains as measured on scanning electron micrographs using a Zeiss MOP III Image Analyzer was found to be 0.5 μm. The average thickness, by measurement of the micrographs, was found to be 0.038 μm, resulting in an aspect ratio of approximately 13:1.

The invention has been described with particular reference to preferred embodiments thereof, but it will be understood that variations and modifications can be effected within the spirit and scope of the invention.

What is claimed is:

1. A photographic element capable of forming a reversal image comprising
- a support and,
- coated on said support, at least one image recording emulsion layer comprised of
  - a dispersing medium and
  - a blend of
    - radiation sensitive tabular silver haloiodide grains having a thickness of less than 0.5 μm and an average aspect ratio of greater than 8:1 accounting for at least 35 percent of the total grain projected area of said emulsion layer and
    - a second grain population present in a concentration sufficient to increase speed and contrast, said second grain population being incapable of forming a latent image extending the exposure latitude imparted to said emulsion layer by said tabular grains, having an average diameter less than that of said tabular grains and less than 0.5 μm, consisting essentially of a silver salt more soluble than silver iodide, and containing less iodide than said tabular grains.

2. A photographic element capable of forming a reversal image according to claim 1 wherein said radiation sensitive tabular silver haloiodide grains having a thickness of less than 0.3 μm and an average aspect ratio of greater than 8:1 account for at least 50 percent of the total grain projected area of said emulsion layer.

3. A photographic element capable of forming a reversal image according to claim 2 wherein said radiation sensitive tabular silver haloiodide grains having a thickness of less than 0.2 μm and an average aspect ratio of greater than 8:1 account for at least 70 percent of the total grain projected area of said emulsion layer.

4. A photographic element capable of forming a reversal image according to claim 1 wherein said tabular silver haloiodide grains contain less than 8 mole percent iodide. based on silver.

5. A photographic element capable of forming a reversal image according to claim 1 wherein said second grain population consists essentially of a silver salt having a solubility product constant less than 16 at 20° C.

6. A photographic element capable of forming a reversal image according to claim 4 wherein said second grain population consists essentially of a silver salt having a solubility equal to or greater than that of silver bromide.

7. A photographic element capable of forming a reversal image according to claim 1 wherein said second grain population is present in a concentration of at least 0.5 mole percent, based on total silver present in said image recording emulsion layer.

8. A photographic element capable of forming a reversal image according to claim 1 wherein said photographic element contains a dye image forming coupler.

9. A multicolor photographic element capable of forming a viewable reversal dye image comprising
- a support and, coated on said support,
- a blue recording yellow dye image forming layer unit,
- a green recording magenta dye image forming layer unit, and
- a red recording cyan dye image forming layer unit,
- at least one of said dye image forming layer units being comprised of an image recording emulsion layer comprised of
  - a dispersing medium and
  - a blend of
    - radiation sensitive tabular silver bromoiodide grains containing less than 8 mole percent iodide having a thickness of less than 0.3 μm and an average aspect ratio of greater than 8:1 accounting for at least 50 percent of the total grain projected area of said emulsion layer and
    - a second grain population which is incapable of forming a latent image extending the exposure latitude imparted to said emulsion layer by said tabular grains, is present in a concentration of from 0.5 to 50 mole percent, based on total silver in said image recording emulsion layer, has an average diameter less than that of said tabular grains and less than 0.5 μm, consists essentially of a silver salt having a solubility product constant of 15.5, and contains less iodide than said tabular grains.

10. A multicolor photographic element capable of forming a viewable reversal dye image according to claim 9 wherein said green and red recording dye image forming layer units each contain an image recording emulsion layer comprised of
- a dispersing medium and
- a blend of
  - radiation sensitive tabular silver haloiodide grains containing less than 8 mole percent iodide, having a thickness of less than 0.3 μm and an average aspect ratio of greater than 8:1 accounting for at least 50 percent of the total grain projected area of said emulsion layer and
  - a second grain population which is incapable of forming a latent image extending the exposure latitude imparted to said emulsion layer by said tabular grains, is present in a concentration of from 0.5 to 50 mole percent, based on total silver in said image recording emulsion layer, has an average diameter less than that of said tabular grains and less than 0.5 μm, consists essentially of a silver salt having a solubility product constant of 15.5, and contains less iodide than said tabular grains.

11. A multicolor photographic element capable of forming a viewable reversal dye image according to claim 9 wherein said tabular grains have an average aspect ratio of at least 12:1.

12. A multicolor photographic element capable of forming a viewable reversal dye image according to claim 9 wherein said tabular grains contain from 1 to 7 mole percent iodide, based on silver.

13. A multicolor photographic element capable of forming a viewable reversal dye image according to claim 12 wherein said tabular grains contain from 2 to 6 mole percent iodide, based on silver.

14. A multicolor photographic element capable of forming a viewable reversal dye image according to claim 9 wherein said grains having a solubility product constant of 15.5 or less have an average diameter of less than 0.3 μm.

15. A multicolor photographic element capable of forming a viewable reversal dye image according to claim 14 wherein said grains having an average diameter of less than 0.3 μm have a solubility product constant at 20° C. in the range of from 11 to 13.

16. A multicolor photographic element capable of forming a viewable reversal dye image according to claim 15 wherein said grains having an average diameter of less than 0.3 μm are present in a concentration of at least 1 mole percent. based on total silver present in said image recording emulsion layer.

17. A multicolor photographic element capable of forming a viewable reversal dye image according to claim 16 wherein said grains having an average diameter of less than 0.3 μm are present in a concentration in the range of from 5 to 50 mole percent, based on total silver present in said image recording emulsion layer.

18. A multicolor photographic element capable of forming a viewable reversal dye image comprising a support and, coated on said support, a blue recording yellow dye image forming layer unit, a green recording magenta dye image forming layer unit, and a red recording cyan dye image forming layer unit, at least one of said dye image forming layer units being comprised of an image recording emulsion layer comprised of a dispersing medium and a blend of radiation sensitive tabular silver bromoiodide grains containing less than 8 mole percent iodide having a thickness of less than 0.3, a diameter of at least 0.6 μm, and an average aspect ratio of greater than 8:1 accounting for at least 50 percent of the total grain projected area of said emulsion layer and grains having an average diameter of less than 0.3 μm consisting essentially of silver thiocyanate present in a concentratin of from 0.5 to 50mole percent, based on total silver in said image recording layer.

19. A multicolor photographic element capable of forming a viewable reversal dye image according to claim 15 wherein said grains having a solubility product constant in the range of from 11 to 13 have an average diameter of less than 0.1 μm.

20. A multicolor photographic element capable of forming a viewable reversal dye image according to claim 19 wherein said grains having an average diameter of less than 0.1 μm consist essentially of at least one of silver bromide and silver chloride.

21. A multicolor photographic element capable of forming a viewable reversal dye image according to claim 20 wherein said grains having an average diameter of less than 0.1 μm consist essentially of silver bromide.

* * * * *